United States Patent [19]

Huber

[11] Patent Number: 4,590,843

[45] Date of Patent: May 27, 1986

[54] LOADING RAMP FOR CARTRIDGES INTERSTAGED BETWEEN A MAGAZINE AND A GUN

[75] Inventor: Wolfgang Huber, Augsburg, Fed. Rep. of Germany

[73] Assignee: KUKA Wehrtechnik GmbH, Fed. Rep. of Germany

[21] Appl. No.: 295,601

[22] Filed: Aug. 19, 1981

[30] Foreign Application Priority Data

Aug. 19, 1980 [DE] Fed. Rep. of Germany ..... 3031204

[51] Int. Cl.[4] ..... F41D 10/38; F41F 9/00

[52] U.S. Cl. ..... 89/45; 89/36.13; 89/47

[58] Field of Search ..... 89/45, 46, 47, 36 K, 89/33.05, 33.01, 33.14, 33.1, 33.2, 36.13

[56] References Cited

U.S. PATENT DOCUMENTS

| | | | |
|---|---|---|---|
| 1,128,555 | 2/1915 | Vickers et al. | 89/45 |
| 2,608,135 | 8/1952 | Aldrin | 89/45 |
| 2,907,251 | 10/1959 | Sahlberg | 89/47 |
| 3,238,845 | 3/1966 | Christiansson | 89/46 |
| 3,276,322 | 10/1966 | Christiansson | 89/33.05 |
| 3,314,332 | 4/1967 | Wallin | 89/45 |
| 3,319,525 | 5/1967 | Jafwert | 89/45 |
| 4,388,854 | 6/1983 | Dabrowski et al. | 89/47 X |
| 4,457,209 | 7/1984 | Scheurich et al. | 89/45 |
| 4,481,860 | 11/1984 | Schiele et al. | 89/36 K |

FOREIGN PATENT DOCUMENTS

| | | | |
|---|---|---|---|
| 3046642 | 7/1982 | Fed. Rep. of Germany | 89/47 |
| 2037409 | 7/1980 | United Kingdom | 89/46 |

*Primary Examiner*—David H. Brown
*Assistant Examiner*—John E. Griffiths
*Attorney, Agent, or Firm*—McGlew and Tuttle

[57] ABSTRACT

A loading ramp for cartridges to be supplied from a magazine to a gun of an armored vehicle turret comprises a ramp tube which defines a path of travel for the cartridge from the magazine to the gun. A rocker is pivotally mounted to the bottom of the ramp tube at an end of the tube near the gun. The rocker has a first rocker lever which is near the gun and a second rocker lever which is spaced away from the gun. The second rocker lever carries a stopping cam which can be engaged by the flange of a cartridge to pivot the rocker so that the first rocker lever rises. The first rocker lever is in a correct position for raising the forward end of the cartridge to center it with the gun barrel axis. The rocker is also spring loaded so that the stopping cam is biased into the ramp tube awaiting the passage of a cartridge flange.

6 Claims, 3 Drawing Figures

LOADING RAMP FOR CARTRIDGES INTERSTAGED BETWEEN A MAGAZINE AND A GUN

With a thin, sensitive-jacketed cartridge powder charge a precisely centered insertion thereof into the gun bore is required in order to avoid any damage to the cartridge by the scratching of or scraping on the sharp-edged annular collar, by which the bore wall is plugged into the breech.

The object of the invention, therefore, is with cartridges having a bottom flange—because of which they naturally advance with their tip pointed downward if being pushed forward by the ram behind—to center the cartridges on the final forward feed home on the bore axis.

This problem is solved according to the invention in that, on the bottom of the loading ramp at its end nearest the gun, a rocker is provided. The rocker is pivotally mounted to the ramp on an axis which extends across the gun barrel bore axis. The rocker has a first rocker lever near the gun, and a second rocker lever spaced away from the gun, this second lever having a spring loaded stopping cam which projects into the traveling path of the cartridge bottom flange in such a way that on a runup thereof, the first rocker lever centers the cartridge on the bore axis.

According to the invention the cartridge bottom flange runs up on the abutting surface of the stopping cam to push downward thereon, which action is mechanically produced under the sliding pressure of the ram, because, of course, the cartridge bottom flange is embraced by the loading ramp with only a minor play. Thus the pressure that the flange can exert of the stopping cam is sufficient to lift the first rocker lever together with the proportional weight component of the cartridge resting on it. This lift can be adjusted precisely up to the bore axis level by a downward controlled stopping cam stroke.

Figure 1:
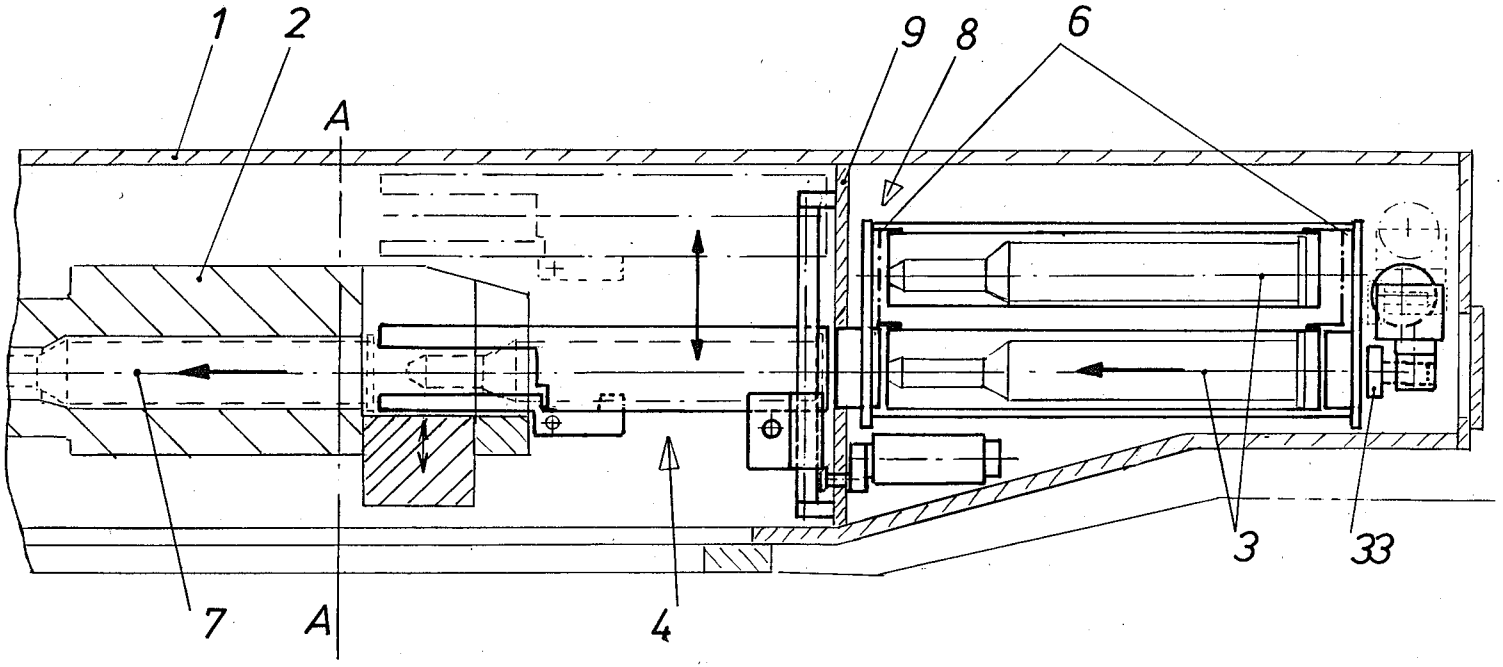
Figure 2:
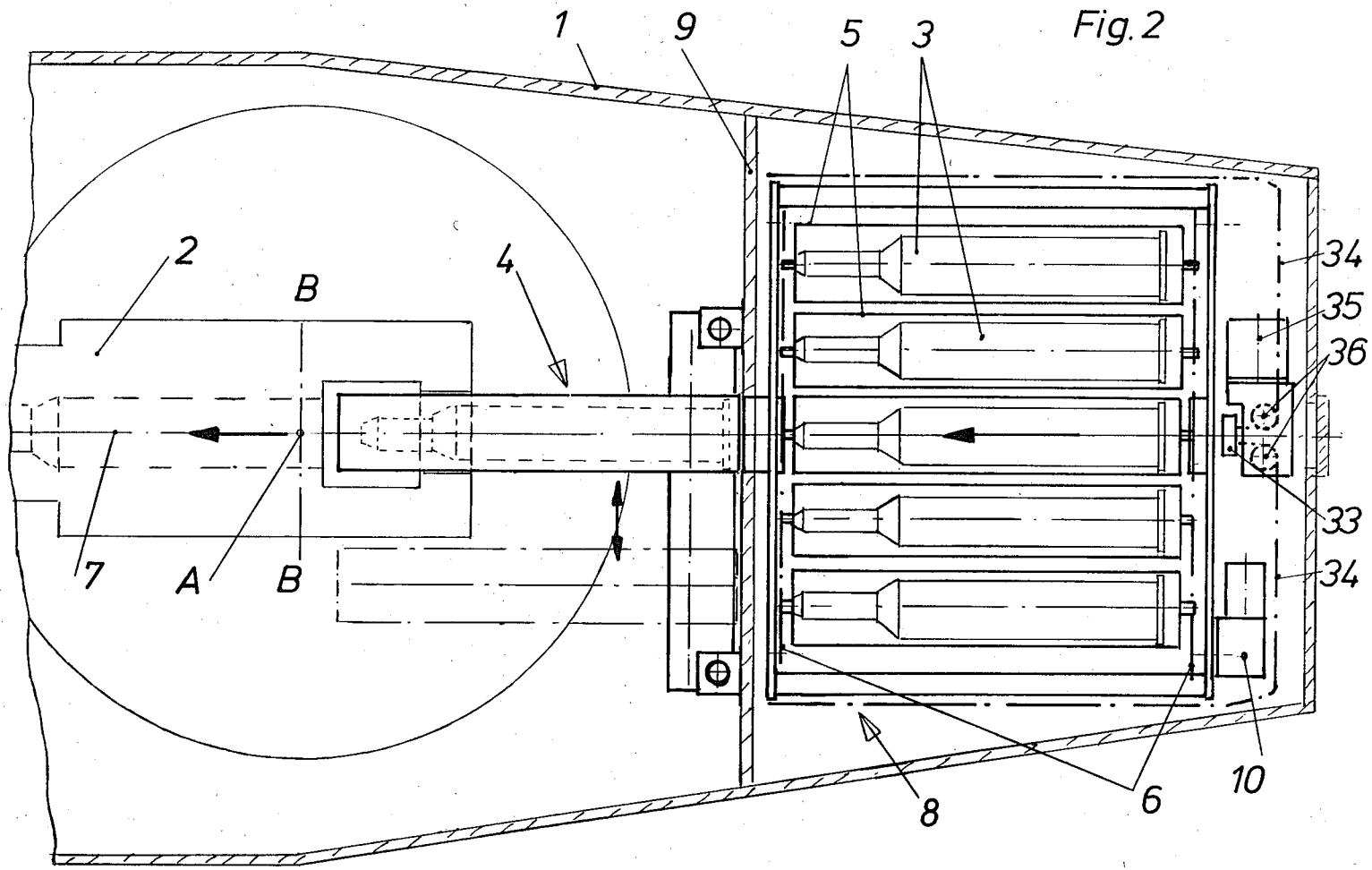

An embodiment of the invention is shown schematically in the attached drawing, wherein:

FIG. 1 shows a longitudinally cut vertical section of a tank turret rear with magazine;

FIG. 2 a top view of FIG. 1; and

Figure 3:
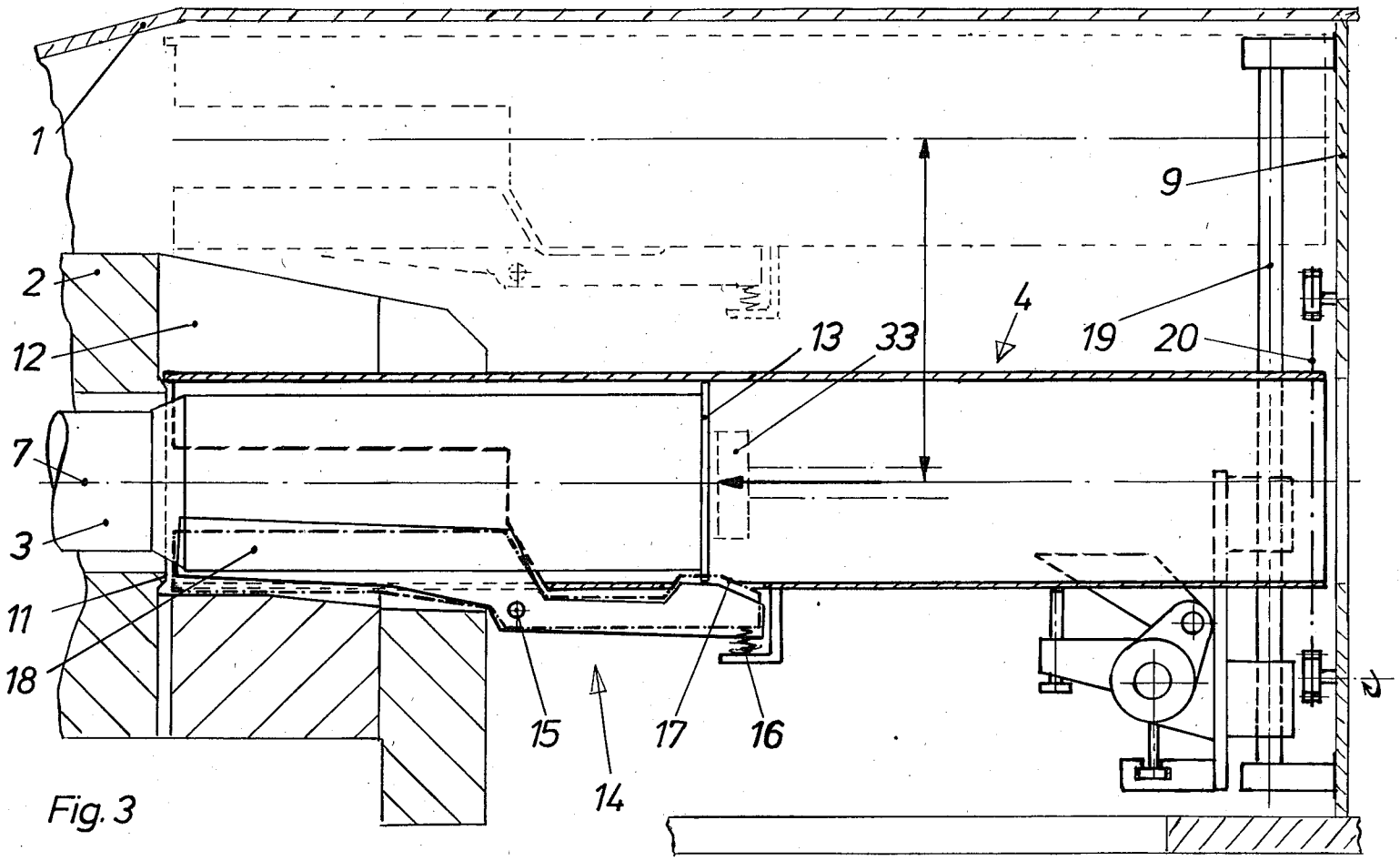

FIG. 3 an enlarged cutout from FIG. 1 with a cut-through loading ramp.

FIGS. 1 and 2 show the rear of a tank or armored vehicle turrent 1, which is pivotable around a vertical-axial line A—A. Supported in 1 there is a gun 2, which is tiltable upward around a trunnion-axial line B—B. The loading of gun 2 with a cartridge case 3 is done from a tubular container 5 via a loading ramp or ramp member 4, the container being a component of a magazine 8 revolving on the endless track 6 of a chain pair across the bore axis 7 of gun 2. In this case that container 5, from which the loading is made, is disposed on the end of endless-track 6 in a position being aligned with the bore axis 7 of gun 2. For this purpose the gun 2 is swiveled into elevation "0". At this alignment angle the partition wall 9, which separates the magazine 8 from the rest of the tank turrent space, has a hole. Revolutions of magazine 8 along conveyor chain track 6 can be powered by a motor 10 or, under emergency conditions, can also be manually produced.

Enlarged FIG. 3 supplies a better view of how the rear bore opening of gun 2 is plugged into breach 12 by means of a sharp-edged annular collar 11 and thus—in case of a not exactly centered insertion of the cartridge from its magazine container 5 by ram 33 via loading ramp 4—is potentially damaging to the cartridge. Particularly with a thin, sensitive-jacketed cartridge powder charge, this cartridge can be scratched up or even torn open. For this type of ammunition a bottom flange 13 is provided. The loading ramp 4 has an outer contour so that it can be inserted downwardly into the top of the breech 12, as shown primarily in FIG. 2. The direction of insertion is shown by the long double arrow in FIG. 1. A rocker 14 is pivotally mounted to the bottom of ramp 4 near gun 2. Rocker 14 has a first rocker lever 18 close to the gun 2, and a second rocker lever spaced away from the gun 2. The rocker 14 is pivotable on an axis 15 perpendicular to bore axis 7. Its second rocker lever has a stopping cam 17 for the cartridge bottom or base flange 13, which cam projects up under the load of a compression spring 16. On a runup of the flange the first rocker lever 18 having a shell shape is lifted up so that the cartridge 3 is centered on the bore axis 7. Subsequently the cartridge can be slid along the sharp-edged annular collar 11 without any danger of damage.

The stroke of stopping cam 17 is downward limited by a stop, by which this limitation also can be precision adjusted. A ledge on which spring 16 is mounted, for example, can serve as this stop.

Preceding each firing, the loading ramp or ramp member 4, which essentially is a tube, is upward laterally swiveled to make room for recoil after the gun has been fired. For swiveling purposes a suitably combined hoisting-and-sliding gear having a perpendicular guide linkage of bars 19 and a chain loop 20 (as indicated) is used. Ramp member 4 defines a path for the cartridge from the magazine to the gun.

The invention introduces a key improvement on a subassembly for an automatic large-caliber ammunition loading device. To load the gun 2 via the loading ramp 4 the cartridge 3 is pushed out of the container 5 by the ram 33. For this purpose the ram is moved by a pair of rigid chains 34 via a motor 35 or under emergency conditions also by manually operated deflector rollers 36.

I claim:

1. A loading ramp apparatus for cartridges to be supplied from a magazine to a gun of an armored vehicle turret, the gun having a bore with a bore axis and the cartridges having a base flange, the loading ramp apparatus comprising a ramp member defining a path of travel for a cartridge from the magazine to the gun bore, a rocker pivotally mounted to the ramp member on a pivot axis which extends perpendicularly to the bore axis, said rocker being mounted on said ramp member near an end of said ramp member adjacent the gun and at a bottom of said ramp member, said rocker having a first rocker lever adjacent said end of said ramp member and near the gun, and a second rocker lever spaced away from said end of said ramp member and spaced away from the gun, said second rocker lever having a stopping cam thereon, a spring engaged with said rocker for biasing said stopping cam into said path of travel to an extent, said first and second rocker levers extending from said pivot axis in substantially opposite directions, and said first rocket lever being substantially out of said path of travel when said stopping cam is extending into said path of travel, so that, with a cartridge moving on said path of travel, a base flange of the cartridge engages said stopping cam and pivots said rocker against the biasing of said spring to move said stopping cam away from said path of travel and to move said first rocker lever toward said path of travel whereby said first rocker lever raises a forward end of a cartridge when the base flange of the cartridge engages said stopping cam, said stopping cam and said first rocker lever being shaped so that with a base flange of a cartridge engaged with said stopping cam said first rocker lever centers a cartridge with the bore axis.

2. An apparatus according to claim 1, including a stop connected to said ramp member and positioned so as to be engaged by said second rocker lever to establish a position of maximum rotation for said rocker when a base flange of a cartridge engages said stopping cam.

3. An apparatus according to claim 1, wherein said axis on which said rocker is pivotally mounted is positioned between said first and second rocker levers.

4. An apparatus according to claim 1, wherein said first rocker lever has a curved shape to receive a curved outer contour of a cartridge.

5. An apparatus according to claim 3, wherein said first rocker lever has a curved shape to receive a curved outer contour of a cartridge.

6. An apparatus according to claim 5, wherein said spring is engaged with said second rocker lever.

* * * * *